United States Patent [19]

Nakada

[11] 4,044,504

[45] Aug. 30, 1977

[54] SASH WINDOW WITH WEATHERTIGHT SEALING MEANS

[75] Inventor: Katsuo Nakada, Kurobe, Japan

[73] Assignee: Yoshida Kogyo Kabushiki Kaisha, Tokyo, Japan

[21] Appl. No.: 709,337

[22] Filed: July 28, 1976

[30] Foreign Application Priority Data

Aug. 8, 1975 Japan ..... 50-110307[U]

[51] Int. Cl.[2] ..... E05D 13/02

[52] U.S. Cl. ..... 49/425; 16/96 R; 52/207; 160/90

[58] Field of Search ..... 49/425, 427, 411, 404, 49/421; 160/90, 91; 52/207; 16/96 R, 96 L

[56] References Cited

U.S. PATENT DOCUMENTS

| | | | |
|---|---|---|---|
| 2,897,552 | 8/1959 | Kiefer | 49/425 |
| 3,324,597 | 6/1967 | Rich | 49/425 X |
| 3,442,052 | 5/1969 | Levine | 49/425 |
| 3,984,954 | 10/1976 | Takeda | 160/90 X |

*Primary Examiner*—Philip C. Kannan

*Attorney, Agent, or Firm*—Hill, Gross, Simpson, Van Santen, Steadman, Chiara & Simpson

[57] ABSTRACT

In a dual sash window assembly having a pair of overlapping sashes mounted within an outer frame for relative horizontal movement, the outer frame has a stepped sill, with a pair of parallel spaced rails formed thereon as upward extensions from the risers of two of the steps. Mounted on the respective rails for rolling movement therealong, the sashes have bottom horizontal frame members carrying weathertight sealing strips arranged to make sliding engagement with the exterior surfaces of the respective risers of the sill. The sealing strips serve to make the window perfectly weathertight in spite of the presence of dust outlets formed by cutting away parts of the rails.

3 Claims, 3 Drawing Figures

SASH WINDOW WITH WEATHERTIGHT SEALING MEANS

BACKGROUND OF THE INVENTION

1. Field of the Invention

This invention relates to sash windows and is directed more specifically to improvements in weatherproofing, namely in weathertight sealing means for sash windows of the type having horizontally movable sashes.

2. Description of the Prior Art

There has been known a sash window wherein a weathertight sealing strip is attached to either of the inside wall of the bottom horizontal frame member of each horizontally movable sash or an opposed upstanding wall of the sill of the outer window frame, so as to be in sliding engagment with the other. This known arrangement has the disadvantage that rain water can easily collect between the rails and the upstanding sill wall by entering either over the rails or through dust outlets formed by cut away terminal portions of the rails. Moreover, as the sashes are moved up or down relative to the outer window frame at the time of installation so as to be in working position, it is possible that the sealing become placed out of engagement with the desired walls in the normal operating positions of the sashes.

In another known arrangement a weathertight sealing strip is carried by each horizontally movable sash so as to make slidable engagement with the exterior surface of the respective rail. This arrangement also has the disadvantage of permitting intrusion of rain water through dust outlets formed in the rails.

SUMMARY OF THE INVENTION

It is an object of this invention to provide a sash window of the type having horizontally movable sashes, which includes weathertight sealing means capable of preventing the intrusion of wind and rain through dust outlets formed by any cut-away parts of the rails on the sill of an outer frame.

Another object of the invention is to provide a sash window with weathertight sealing means such that, at the time of installation of the window, the sashes can be easily moved up or down relatively to the outer frame to their working positions without the possibility of impairing the weathertightness of the window.

Briefly stated, the invention provides, in a sash window of the type having at least two overlapping sashes independently movable horizontally within an outer frame, the improvement comprising a sill, constituting a part of the outer frame, that is shaped into a series of longitudinally extending steps decreasing in height toward the exterior of the window. The sill steps include risers having upward extensions to provide at least a pair of rails on which the respective sashes are movably mounted. Each sash carries a weathertight sealing strip adapted to make sliding engagement with the exterior surface of the respective riser of the sill.

Usually, the rails terminate short of the opposed side posts or jambs of the outer frame to provide dust outlets. Since the sealing strips carried by the sashes are in sliding engagement with the respective risers under the rails, however, wind or rain cannot enter through the dust outlets when the window is closed.

The above and various other objects, features and advantages of this invention and the manner of attaining them will become more clearly apparent, and the invention itself will best be understood, upon consideration of the following description taken in connection with the accompanying drawings showing a preferred embodiment of the invention.

DESCRIPTION OF THE PREFERRED EMBODIMENT

In the accompanying drawings this invention is shown adapted for a dual sash window assembly of the horizontally rolling type, comprising an outer frame 10 and a pair of relatively movable, overlapping sashes 11 and 12 mounted within the outer frame in parallel, closely spaced planes. Although the drawings show only the sill 13 and side post or jamp 14 of the outer frame 10, of course understood the outer frame additionally comprises a header and another side post. These constituent members of the outer frame are combined rectangularly in any convenient manner, for installation in the usual window receiving opening provided in an enclosing wall of a building.

Figure 2:
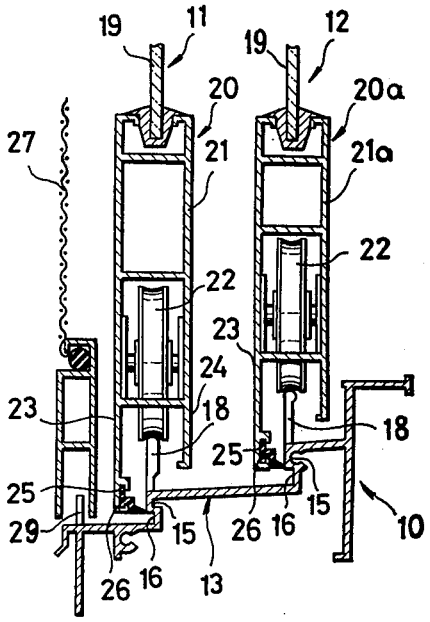
FIG. 2 is a vertical sectional view taken along the line II—II of FIG. 1, the view also showing in a fragmentary vertical cross section a pair of sashes and a screen of the window assembly.
Figure 3:
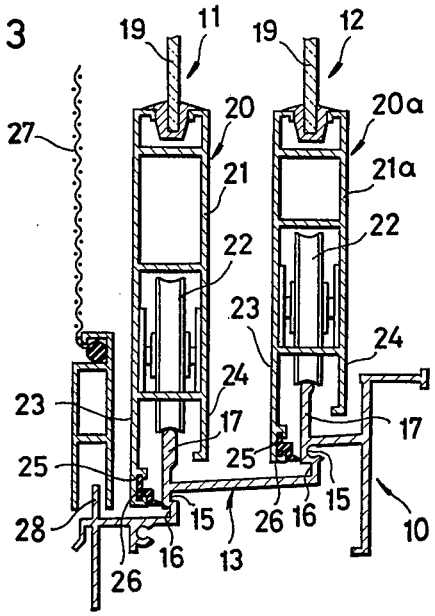
FIG. 3 is a view similar to FIG. 2 but taken along line III—III of FIG. 1.

As best shown in FIGS. 2 and 3, the sill 13 of the outer frame 10 is shaped into a series of longitudinally elongated steps progressively decreasing in height toward the exterior of the window assembly, which is the left side as illustrated in the drawings. The steps include two upstanding risers 15, 15 which are depressed interiorly at their bottom portions 16, 16 throughout their length. These depressions aid in preventing the intrusion of rain water or the like into the interior of the window.

The risers 15, 15 extend upwardly beyond the adjacent substantially horizontal portions of the steps to provide a pair of parallel spaced rails 17, 17, which terminate short of at least one of the side posts 14 to provide a pair of dust outlets 18.

Each sash 11, 12 includes a panel of pane 19 of glass or other suitable material and a rectangular inner frame **20, 20*a* extending along and embracing the periphery of the respective panel 19. Each inner frame 20, 20*a* includes a bottom horizontal member 21, 21*a* in which there are rotatably mounted a plurality of rollers 22 for rolling engagement with the respective rail 17. The sashes 11 and 12 can therefore be independently rolled along the respective rails 17** for opening and closing the window.

The bottom horizontal frame members **21, 21*a* have a pair of opposed flanges 23 and 24 extending downwardly. Of these the exterior flange 23, which is of greater vertical dimension than the other flange 24, has an undercut groove 25 along its lower marginal portion supporting a weathertight sealing strip 26. These sealing strips 26 make slidable engagement with the external surfaces of the respective risers 15, just above the depressions 16**.

Figure 1:
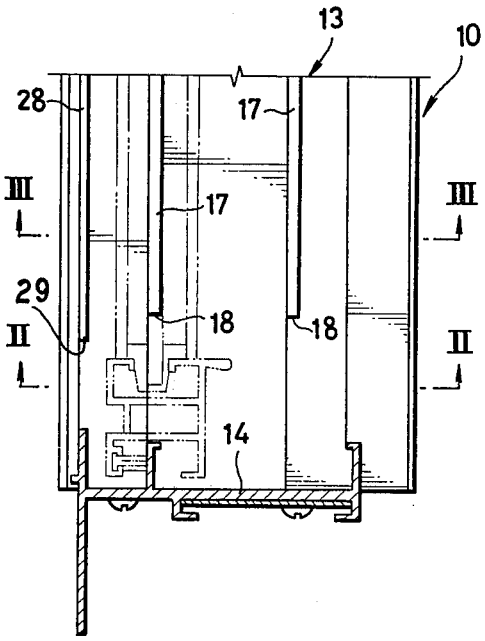
FIG. 1 is a fragmentary plan view of a sill included in the outer frame of a horizontal, dual sash window assembly constructed in accordance with the novel concepts of this invention, the view also showing in horizontal cross section one of the side posts of the outer frame.

A screen 27 may be slidably mounted on an additional rail 28 formed on and along the outermost edge of the sill 13. The screen 27 prevents the intrusion of insects when the window is open. The rail 28 terminates short of at least one of the side posts 14 to provide a dust outlet 29 as shown in FIG. 1.

Although there is disclosed only the weathertight sealing means between the sill and the bottom horizontal frame members of the sashes, other necessary parts of the window assembly are also sealed by suitable means well known to those skilled in the art.

At the time of the installation of the window assembly, the sashes 11 and 12 can be easily moved up and down relative to the outer frame 10 to their precise working positions with the weathertight sealing strips 26 in sliding contact with the external surfaces of the risers 15. The weathertightness of the window assembly is not impaired to the slightest degree by the presence of the dust outlets 18, 18, since the sealing strips 26, 26 make sliding engagement with the risers 15, 15 under the rails 17, 17. Furthermore, the weathertightness is still more augmented as the sealing strips are pressed against the external surfaces of the risers under the force of the wind, so that the intrusion of wind and rain is positively prevented.

While this invention has been shown and described in terms of a specific embodiment, it is understood that the invention is not to be restricted by the exact showings or the drawings or the description thereof. It is also recognized that the principles of the invention are applicable to other than the illustrated type of sash window. In practice, therefore, such deviations from this disclosure may be resorted to as they do not form a departure from the scope of the invention, as defined by the following claims.

What is claimed is:

1. In a sash window of the type having at least two overlapping sashes independently movable horizontally within an outer frame, wherein each of the sashes includes an inner frame extending along and embracing the periphery of a panel, the improvement comprising a sill included in said outer frame, said sill being formed into a series of longitudinally extending steps decreasing in height toward the exterior of the window, said steps including risers, and at least a pair of upstanding rails formed by upward extensions of said risers respectively, said sashes being supported respectively on said rails for horizontal movement therealong, and a weathertight sealing strip carried by said inner frame of each of said sashes respectively in sliding engagement with the exterior surface of said risers.

2. A sash window as recited in claim 1, wherein the bottom end portion of each of said risers is depressed interiorly throughout the length thereof.

3. A sash window according to claim 1, said rails having outlets extending therethrough sealed from the exterior atmosphere by said sealing strip.

* * * * *